US005710820A

United States Patent [19]

Martin et al.

[11] Patent Number: 5,710,820

[45] Date of Patent: Jan. 20, 1998

[54] PROGRAMMABLE HEARING AID

[75] Inventors: Raimund Martin, Eggolsheim; Werner Hohn, Uttenreuth; Reinhard Kern, Eckental, all of Germany

[73] Assignee: Siemens Augiologische Technik GmbH, Erlangen, Germany

[21] Appl. No.: 407,953

[22] Filed: Mar. 22, 1995

[30] Foreign Application Priority Data

Mar. 31, 1994 [EP] European Pat. Off. ..... 94105192

[51] Int. Cl.[6] ..... H04R 25/00

[52] U.S. Cl. ..... 381/68.4; 381/68.2

[58] Field of Search ..... 381/68–69.2

[56] References Cited

U.S. PATENT DOCUMENTS

| | | | |
|---|---|---|---|
| 4,425,481 | 1/1984 | Mansgold | 381/68 |
| 4,592,087 | 5/1986 | Killion | 381/68 |
| 4,596,900 | 6/1986 | Jackson | 179/84 |
| 4,622,440 | 11/1986 | Slavin | 381/68 |
| 4,689,819 | 8/1987 | Killion | 381/68 |
| 4,792,977 | 12/1988 | Anderson et al. | 381/68 |
| 4,845,755 | 7/1989 | Busch et al. | 381/68 |
| 4,901,353 | 2/1990 | Widin | 381/68 |
| 4,918,736 | 4/1990 | Bordewijk | 381/68 |
| 4,972,487 | 11/1990 | Mansgold | 381/68 |
| 4,989,251 | 1/1991 | Mansgold | 381/68.2 |
| 4,992,966 | 2/1991 | Widin et al. | 381/68 |
| 4,995,085 | 2/1991 | Kern et al. | 381/68.2 |
| 5,083,312 | 1/1992 | Newton et al. | 381/68.4 |
| 5,091,952 | 2/1992 | Williamson et al. | 381/68.2 |
| 5,210,803 | 5/1993 | Martin et al. | 381/68.2 |
| 5,265,168 | 11/1993 | Schiess et al. | 381/69 |
| 5,276,739 | 1/1994 | Krokstad et al. | 381/68.2 |
| 5,278,912 | 1/1994 | Waldhauser | 381/68.4 |
| 5,341,433 | 8/1994 | Meyer et al. | 381/69 |
| 5,384,852 | 1/1995 | Scharen | 381/68 |
| 5,404,407 | 4/1995 | Weiss | 381/68.7 |
| 5,524,150 | 6/1996 | Sauer | 381/68.2 |
| 5,537,477 | 7/1996 | Gauthier et al. | 381/68.2 |
| 5,539,806 | 7/1996 | Allen et al. | 381/68.4 |
| 5,608,803 | 3/1997 | Magotra et al. | 381/68.4 |
| 5,613,008 | 3/1997 | Raimund et al. | 381/68.4 |
| 5,629,985 | 5/1997 | Thompson | 381/68.2 |

FOREIGN PATENT DOCUMENTS

| | | |
|---|---|---|
| 40 31 132 | 8/1991 | Germany . |
| 671 131 | 7/1989 | Switzerland . |
| WO 83/02212 | 6/1983 | WIPO . |

OTHER PUBLICATIONS

"A Set of Four IC's in CMOS Technology for a Programmable Hearing Aid," Callias et al., IEEE J. Solid–State Cir., vol. 24, No. 2, Apr. 1989 (pp. 301–311).

"Das programmierbare Hörgerät PHOX–ein Spitzenprodukt an der Grenze des Machbaren," Ascom Technische Mitteilungen, No. 2, 1990 (pp. 21–26).

Patent abstracts of Japan vol. 12, No. 293 (E–645), Japanese patent 63070613.

*Primary Examiner*—Curtis Kuntz
*Assistant Examiner*—Rexford N. Barnie
*Attorney, Agent, or Firm*—Hill, Steadman & Simpson

[57] ABSTRACT

A hearing aid that has an analog part with a Class D final amplifier stage for audio signal processing, a digital part with an interface, a memory stage as well as supply stage for generating the voltage and control signals. The hearing aid has a utilized integrated circuit which also includes a pre-amplifier stage with two inputs respectively connected to a microphone and a telephone coil, the signals from the two inputs being selectively pre-amplified individually or in common, with selectable or programmable gains. This gives the hearing aid a small structural size, a comprehensive functionality, versatile adaptability and especially low energy consumption.

37 Claims, 2 Drawing Sheets

PROGRAMMABLE HEARING AID

BACKGROUND OF THE INVENTION

1. Field of the Invention

The present invention is directed to a hearing aid of the type wherein at least a portion of the processing of the incoming audio signals is undertaken in accordance with a program, such as a program set at the time of manufacture of the hearing aid, with some program parameters being alterable by an audiologist at the time the hearing aid is matched to the hearing impairment of a particular user, and/or by the person wearing the hearing aid during the course of use thereof.

2. Description of the Prior Art

Programmable hearing aids are generally known which include an analog part for audio signal processing, with certain components in the audio part being controlled by control signals produced by a digital part of the hearing aid. In such known hearing aids, the audio part generally includes a microphone, a pre-amplifier, means for automatic gain control, a filter stage, a Class D final amplifier and means for setting the amplification gain of that amplifier, and an earphone. The digital part includes a memory in which programmed operating parameters are stored, some of which can be altered by an audiologist or by the person wearing a hearing aid, as well as a serial interface. A power supply stage is also provided for generating the necessary voltages for the components of the analog and digital parts.

SUMMARY OF THE INVENTION

An object of the present invention is to provide a hearing aid of the type generally described above which, given a small structural size, nonetheless has a comprehensive functionality, a versatile adaptability, and a low power consumption.

In a programmable hearing aid of the type generally described above, this object is inventively achieved by providing amplifier means for selectively amplifying the signals of the inputs amplified individually or in common, and wherein the gain of the amplifier means is selectable or programmable.

For telephoning, the hearing aid of the invention offers the possibility of utilizing a telephone or induction coil in such a way that only the telephone partner is audible in a first, exclusive T-function. If desired, however, the respective microphone and telephone coil inputs can be programmed with equal transmissivity; the hearing-impaired person then also hears the surrounding environment. Further, the microphone can be attenuated with one setting so that the telephone partner can be clearly heard and the surrounding environment can be heard only muffled. The hearing aid of the invention thus offers the advantage that the hearing-impaired person can decide while telephoning whether the ambient noise should be co-amplified via the microphone or should be mixed-in attenuated, i.e., the hearing aid microphone can remain in operation attenuated when telephoning, so that the telephoning, hearing-impaired person can also perceive ambient signals. In addition to these telephone programs, it is also possible to adapt the hearing aid to various auditory situations with loud or less loud ambient noises.

In a further embodiment, the circuit of the hearing aid of the invention is constructed such that function blocks of the integrated circuit that are not needed can be disconnected and the power consumption of the circuit is thus adapted to the requirements of the auditory program that is active at the moment. The service life of the battery supplying the circuit is thus extended.

DESCRIPTION OF THE PREFERRED EMBODIMENTS

Figure 1:
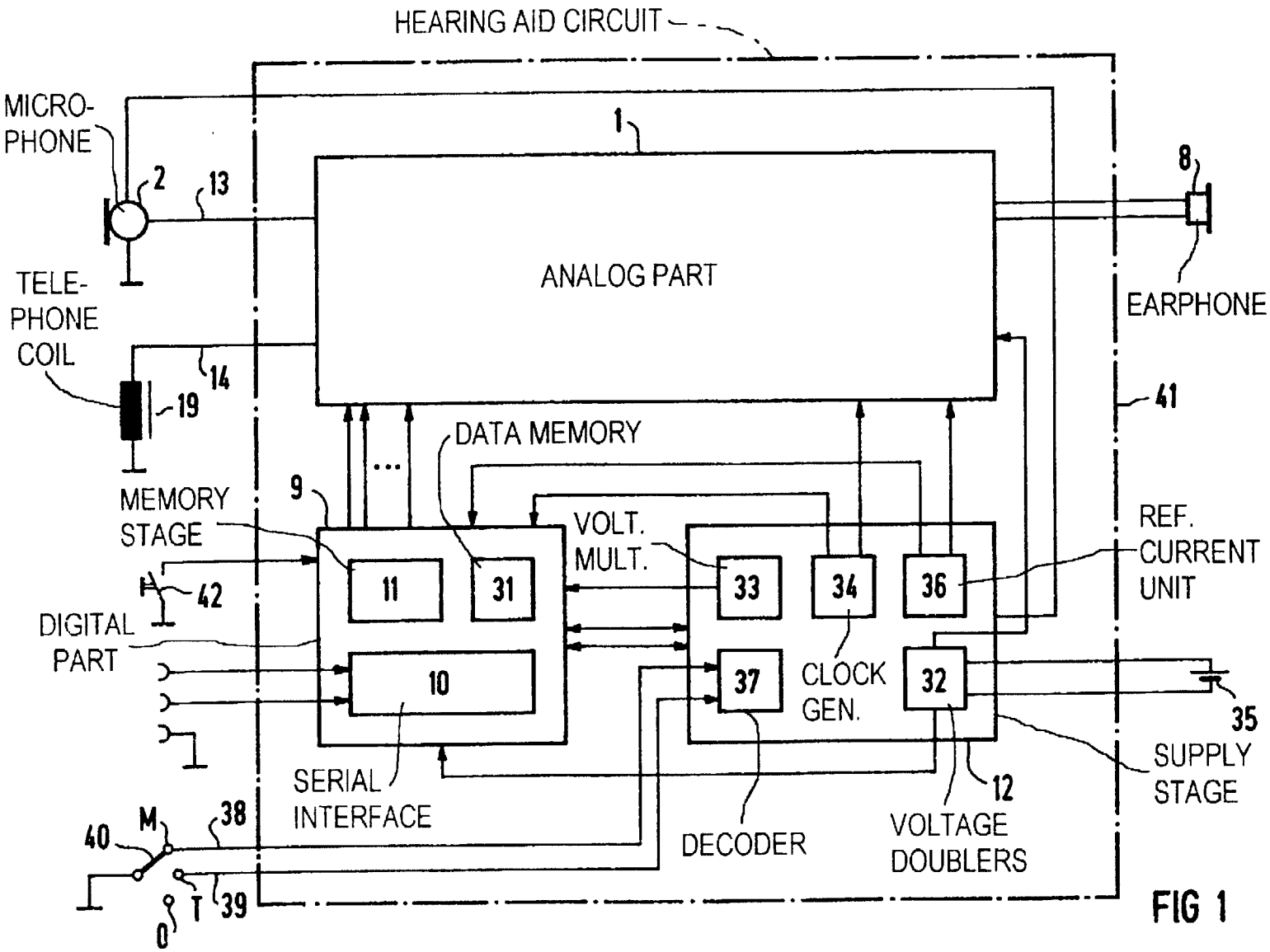
FIG 1 is a block circuit diagram of an integrated circuit of a programmable hearing aid of the invention.

The amplifier circuit for a hearing aid of the invention can be part of an integrated hearing aid circuit 41, possibly as a single IC. The hearing aid circuit 41 includes an analog part 1, a digital part 9 and a supply stage 12. The hearing aid is augmented by a microphone 2 and an earphone 8 as well as by a battery or voltage source 35. In the exemplary embodiment, the hearing aid is also provided with a serial interface 10, a telephone or induction coil 19 and a switch 40, for example for switching the hearing aid from microphone operation to telephone operation (MT switch) or a so-called MTO switch (for switching the hearing aid on to microphone operation, for switching to telephone operation/induction coil mode, and for switching the hearing aid off/0-position).

Figure 2:
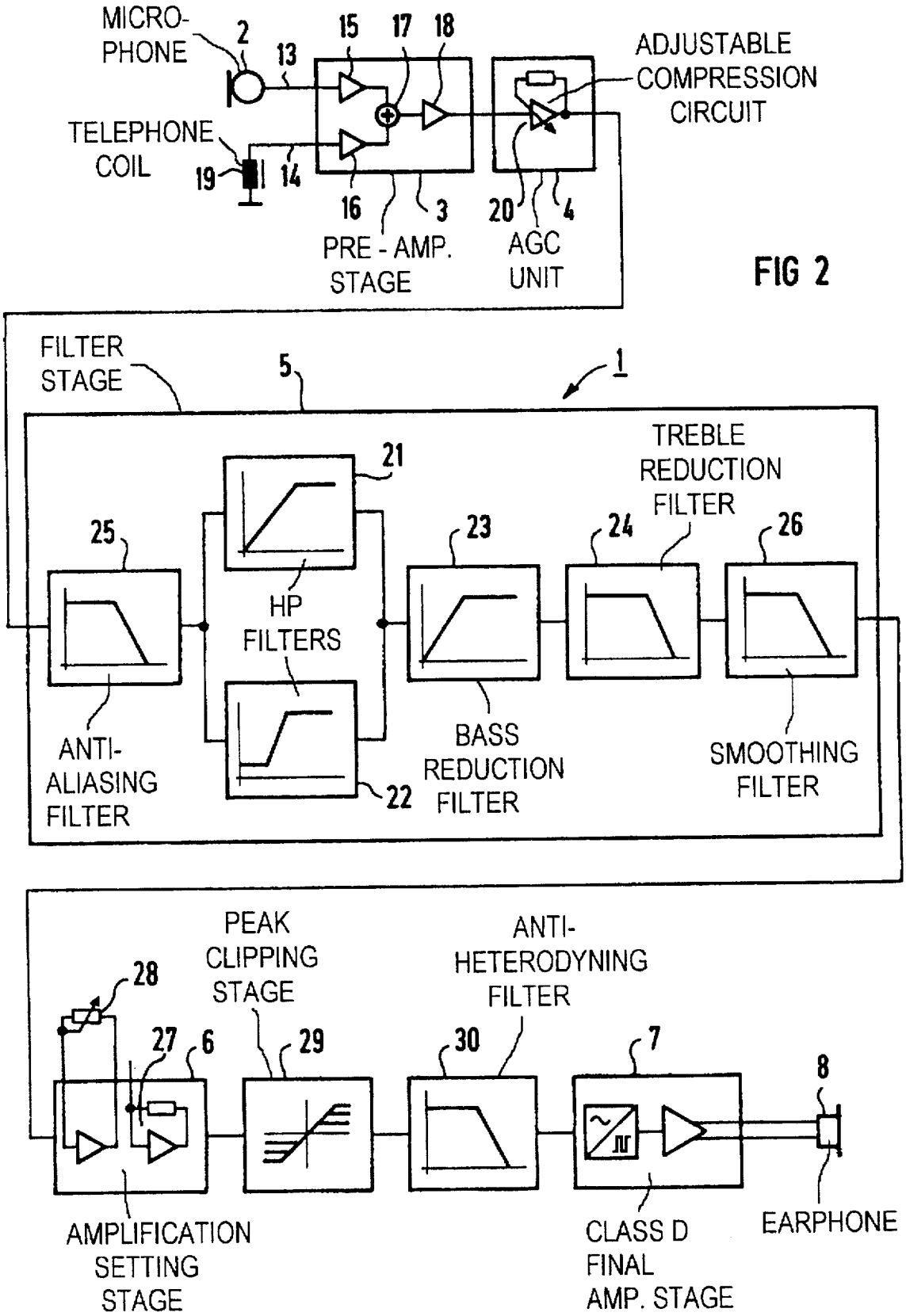
FIG. 2 is a block circuit diagram of an embodiment of an analog part which may be included in the circuit of FIG. 1.

The analog part 1 shown in the exemplary embodiment of FIG. 2 includes a pre-amplifier stage 3, an automatic gain control (AGC) 4, a filter stage 5, an amplification setting stage 6 and a Class D final amplifier stage 7. In the exemplary embodiment, in particular, two separate inputs 13 and 14 to the pre-amplifier stage 3 are provided. The signal input 13 is allocated to the microphone 2 and the signal input 14 is allocated to the telephone coil 19. It is also possible to connected a further signal input source as an audio input processed in parallel with the signal from the microphone 2 or the telephone coil 19. A recognition stage can then be proved at an early location in the processing path to identify, such as by impedance measuring, the connection of such a further signal input.

It is possible to amplify the respective signals of the inputs 13 and 14 either individually or in common. According to FIG. 2, respective amplifier units 15 and 16 are allocated to the signal inputs 13 and 14, and a summing circuit 17 and subsequent amplifier unit 18 are provided, so that the signal inputs can be superimposed and amplified in common.

The AGC unit 4 which follows the pre-amplifier 3 with separate pre-amplification paths has at least one adjustable compression circuit 20 for syllable compression and/or for automatic volume control. for example having an extinction time of more than 10 seconds. An automatic gain control AGC that responds to an input signal beginning with a defined signal level can thereby be provided. It is also possible that the AGC unit 4 can be set in view of the compression ratio and/or in view of the response/decay time. For example, the response/decay time can be influenced by varying the charging current of a capacitor that defines the time constant.

In a further embodiment of the invention, the filter stage 5 of the analog part 1 is formed by high-pass filters 21 and 22, which are provided for simulating/generating different microphone frequency responses. Frequency responses that do not occur in commercially standard microphones can thereby also be realized. The filter stage 5 implemented in SC (switched capacitor) technology enables the employment of a simple, standardized microphone 2 and can simulate or generate different microphone characteristics. Further filters 23 and 24 are likewise implemented as switched capacitor filters, these further filters 23 and 24 being respectively provided for bass or treble reduction and forming an NH or NL tone control. At the input side, the filter stage 5 of the analog part also includes an anti-aliasing filter 25 and the output side thereof includes a smoothing filter 26.

The amplification setting stage that follows in the signal path includes an amplifier stage gain control 27 that can be programmed by the manufacturer at a basic setting for the maximum gain associated with a specific hearing aid. Further, additional setting means that are not shown can be provided, enabling the hearing aid acoustician to reduce the maximum gain prescribed by the manufacture further when adapting the hearing aid to the hearing impairment of a particular hearing aid user. Such setting means can be replaced by the software of a programming device that can be used for the adaptation of the hearing aid. Finally, a volume control/potentiometer 28 is provided for permitting the hearing aid user to modify the gain setting, but only to a limit value set by the manufacturer when increasing the volume, or to a lower limit value set by the acoustician. An additional peak clipping stage 29 limits the input signal symmetrically in conformity with the programmed PC level and thus serves the purpose of limiting the maximum output power. In order to avoid distortions of the Class D final amplifier stage 7 and for band-limitation of the input signal, a filter 30 (anti-heterodyning filter) is arranged in the signal path preceding the energy-saving Class D output stage.

The analog part 1 is further fashioned such that its function blocks are activated by switch means, for example analog switches, to only an extent required for the specific hearing aid type, or for the specific hearing impairment, or for a specific operating mode that has been selected. This means that function blocks of the analog part 1 that are not currently needed can be cut out of the active circuit path and shut off by switch means. The deactivated function blocks require no energy and the hearing aid is thus operated in a battery-saving way.

The programming of the hearing aid ensues via the serial interface 10, whereby programming data can be entered in and stored in one or more memories of a memory stage 11 of the digital part 9. On the basis of the programming data, the digital part 9 acts on the analog part 1 as a control circuit therefor; it also offers balancing or smoothing values for the supply stage 12. The memory stage 11 includes at least one non-volatile memory (EEPROM), whereby one part of this memory is provided for the balancing values or calibration values that assure adherence to the hearing aid data according to the data sheet, and a second part of the memory is provided for basic settings that, for example, contain values for the permissible maximum gain setting (peak clipping) or the like. A third part of the memory is provided for storing parameters or parameter sets for different auditory situations in adaptation to the hearing impairment.

Technical data that are of significance for the selection of the hearing aid type and for matching the hearing aid are obtained from a data sheet that is issued to the hearing aid acoustician together with the hearing aid. The digital part 9 of the hearing aid circuit 41 thus also contains a data memory 31 in which fetchable data relating to the manufacturer, to the hearing aid type, to the circuit type employed or the like are stored. In order to protect certain programming data against undesired modification, special protective means/programming lockouts can be allocated to the data memory 31.

Differing from standard practice, the MTO switch 40 of the invention is not arranged in the battery circuit, but instead forwards digital information about the desired hearing aid mode to the digital part 9, which then formulates (enables) the desired circuit. As a result, a simple MTO switch 40 can be provided which, moreover operates in a less disturbing way than a conventionally connected MTO switch. Further, the switch position "T=telephone mode" of the MTO switch 40 can have a specific, programmed setting of the analog part 1 (auditory situation) allocated to it by the digital part 9. An operating advantage for the hearing aid user arises therefrom since, by selecting the switch position "T", an advantageous hearing aid programming provided for the telephone mode by the hearing aid manufacturer or acoustician is automatically selected. Given employment of a situation key 42, it is possible to cyclically select the program data of various, stored auditory situations.

Finally, the hearing aid circuit 41 includes the supply stage 12. The supply stage 12 supplies the programming voltage of approximately 15 V required for the programming of the memory part 11, this being generated from the battery voltage with charge pumps (a cascade of voltage doublers 32). Further, the supply stage 12 supplies a supply voltage for the analog part 1 that is elevated compared to the battery voltage of about 1.3 V. The supply voltage for the analog part 1, which is preferably doubled to about 2.6 V, is acquired from the battery voltage with a capacitive voltage doubling circuit. Further, the supply stage 12 generates an extremely low-noise voltage of about 1.0 V for supplying the microphone 2. This low-noise voltage is obtained, for example, with a filter network.

It can be seen from FIG. 1, the supply stage 12, using a clock generator 34, generates clock signals for the analog part 1, as well as for the Class D final amplifier stage 7 thereof. The clock generator 34 also supplies clock signals to the filter stage 5 and/or to the voltage doublers 32 or voltage multiplier 33 of the supply stage 12. Further, the supply part 12 has a reference current unit 36 for the central supply of the analog part 1 with reference currents.

For a simple and disturbance-free fashioning of the hearing aid circuit 41, this circuit also remains connected to the battery 35 with the Class D final amplifier stage 7 of the analog part 1. When the digital part 9 and the supply part 12 are in the deactivated condition. The supply stage, however, contains a decoder 37 that controls the operating condition of the hearing aid circuit 41. In what is referred to as the standby mode, thus, all function blocks of the hearing aid circuit 41 except the decoder 37 are deactivatable. Therefore, substantially no energy is consumed in this standby mode. In the active operating condition, the decoder 37 recognizes the respective operating states dependent on input signals 38 and 39 and the function blocks of the hearing aid circuit 41 that correspond to these operating states are activated. The input signals 38 and 39 that identify the operating states for the decoder 37 can be the switch signals of a switch means, for example from the MTO switch 40 or from a situation key 42, or can be the control signals of a remote control receiver of the hearing aid if the hearing aid is of the remote control type. As already mentioned, the switches are not arranged in the battery circuit and can therefore be more simply executed and work in a less disturbing fashion. Since the MTO switch 40 is not arranged in the battery circuit, less interference is coupled into other parts of the hearing aid. Further, switch means for monitoring the voltage of the battery 35 are also provided. Given a voltage drop of the battery in the signal path to the earphone 8, for example, modifications in the gain that serve as a prompt to replace the battery can be effected.

Given an input signal 38 or 39 characterizing the telephone coil mode, data of a data storage portion of the memory stage 11 are activated by the decoder and the amplification unit 16 having the signal input 14 from the telephone coil 19 is driven via the digital part 9. Thus an operating condition predetermined for the telephone coil mode is set, and the frequency response, the gain and the dynamics of the hearing aid for the telephone coil mode can be optimally matched in this way to the hearing impairment of the hearing aid user.

For an energy-saving fashioning of the hearing aid, it is also provided that, dependent on the selected operating condition and on a parameter set programmed for this purpose in the memory stage 11, the digital part 9 drives function blocks of the analog part 1, whereby function blocks not required for the selected operating condition are deactivated and bridged (cut out), so that only the current respectively required for the active function blocks is drawn from the battery 35.

Although modifications and changes may be suggested by those skilled in the art, it is the intention of the inventors to embody within the patent warranted hereon all changes and modifications as reasonably and properly come within the scope of their contribution to the art.

We claim as our invention:

1. A programmable hearing aid comprising:

an analog part for processing incoming audio signals arising in plurality of auditory environments, including a first audio signal source, a second audio signal source comprising a telephone coil, pre-amplifier means for pre-amplifying respective signals from said first and second audio signal sources to produce a pre-amplified output, automatic gain control means for automatically amplifying said pre-amplified output with a variable gain dependent on a characteristic of said pre-amplified output to produce an AGC output, filter means for filtering said AGC output to produce a filtered output, a Class D amplifier means having an input supplied with said filtered output and having an output, for amplifying said filtered output with a selected gain, means connected to said Class D amplifier means for setting said selected gain thereof, and an earphone connected to said output of said Class D amplifier means;

said pre-amplifier means having first and second inputs and first and second amplifier units respectively connected to said first and second inputs, said first input being connected only to said first audio signal source and said second input being connected only to said second audio signal source, said first and second amplifier units each having a settable gain and said first and second amplifier units producing from said first and second audio signal sources, in combination, said pre-amplified output;

a digital part comprising means for generating and supplying a control signal to said pre-amplifier means for independently setting the respective gains of said first and second amplifier units for selectively amplifying said signals from said first and second audio signal sources individually with respectively different gains or in common with the same gain; memory means for storing a stored gain setting for said second amplifier unit for at least one auditory environment using signals from said telephone coil;

manually actuatable switch means for causing said second amplifier unit to be set at said stored gain setting; and power supply means connected to said analog part and to said digital part for supplying operating power to said analog part and said digital part.

2. A programmable hearing aid as claimed in claim 1 wherein said first audio signal source comprises a microphone.

3. A programmable hearing aid as claimed in claim 1 wherein said second audio signal source comprises a telephone coil.

4. A programmable hearing aid as claimed in claim 1 wherein said digital part comprises means for manually switching said means for generating and supplying said control signal for manually selecting individual amplification or common amplification of said signals from said first and second audio signal sources.

5. A programmable hearing aid as claimed in claim 1 wherein said digital part comprises memory means for storing an operating program, connected to said means for generating and supplying said control signal, for selecting individual amplification or common amplification of said signals from said first and second audio signal sources dependent on the stored program.

6. A programmable hearing aid as claimed in claim 1 wherein each of said amplifier units has an output, and wherein said pre-amplifier means further comprises means for summing said outputs of said amplifier units to produce said pre-amplified output.

7. A programmable hearing aid as claimed in claim 1 wherein said automatic gain control means comprises an adjustable compression circuit.

8. A programmable hearing aid as claimed in claim 7 wherein said adjustable compression circuit comprises a compression circuit which responds to a pre-amplified signal starting at a predetermined signal level.

9. A programmable hearing aid as claimed in claim 7 wherein said adjustable compression circuit comprises a circuit which is adjustable dependent on at least one of a compression ratio and a response time.

10. A programmable hearing aid as claimed in claim 1 wherein said filter means comprises a plurality of high-pass filters respectively matched to different frequency responses of one of said first and second audio signal sources.

11. A programmable hearing aid as claimed in claim 10 wherein said filter means comprises, in sequence, an anti-aliasing filter, a plurality of switched capacitor filters, and a smoothing filter.

12. A programmable hearing aid as claimed in claim 10 wherein said filter means comprises a filter for bass reduction and a filter for treble reduction.

13. A programmable hearing aid as claimed in claim 10 further comprising a filter for boosting high frequencies in said AGC output by a selectable amount.

14. A programmable hearing aid as claimed in claim 1 wherein said digital part comprises programmable means for generating and supplying a further control signal to said means for setting said selected gain of said Class D amplifier means for setting a maximum gain programmed into said programmable means by a manufacturer of said programmable hearing aid, and adjustment means, connected to said programmable means, for permitting an acoustician to lower said maximum gain to a new maximum gain.

15. A programmable hearing aid as claimed in claim 14 further comprising volume control means, connected to said means for setting said selected gain of said Class D amplifier means for permitting a user of said hearing aid to select the gain for said Class D amplifier means up to said new maximum gain.

16. A programmable hearing aid as claimed in claim 14 wherein said adjustment means further comprises means for setting a minimum gain for said selected gain of said Class D amplifier means.

17. A programmable hearing aid as claimed in claim 1 further comprising peak clipping means for limiting a maximum output power of said Class D amplifier means, connected between said means for setting said selected gain and said Class D amplifier means.

18. A programmable hearing aid as claimed in claim 1 further comprising an anti-heterodyning filter connected between said means for setting said selected gain and said Class D amplifier means.

19. A programmable hearing aid as claimed in claim 1 wherein said digital part further comprises a memory and interface means for permitting data to be entered into said memory, and said digital part comprising means connected to said memory and to said analog part and to said power supply means for controlling said analog part and for balancing said power supply means dependent on the data in said memory.

20. A programmable hearing aid as claimed in claim 19 wherein said memory comprises a first memory part for storing values for operating said analog part and said power supply means dependent on data set by a manufacturer of said programmable hearing aid, a second part containing data for setting control values for said analog part including a maximum gain of said means for setting said selected gain of said Class D amplifier means, and a third part for storing parameters and parameter sets matched to different auditory situations for controlling said programmable hearing aid dependent on a current auditory situation.

21. A programmable hearing aid as claimed in claim 19 further comprising memory means for storing data identifying a manufacturer of said hearing aid, a hearing aid type and circuit type which can be fetched via said interface means.

22. A programmable hearing aid as claimed in claim 21 further comprising means for protecting data stored in said memory means against unauthorized modification.

23. A programmable hearing aid as claimed in claim 1 wherein said digital part comprises a memory, wherein said first audio signal source comprises a microphone, and wherein said power supply means comprises means for supplying a first voltage to said memory, means for supplying a second voltage to said analog part, and means for supplying a low-noise voltage to said microphone.

24. A programmable hearing aid as claimed in claim 23 wherein said power supply means comprises a battery and means for elevating a voltage of said battery to produce said first and second voltages, and wherein said power supply means further comprises clock signal generator means for supplying clock signals to said analog part and to said means for elevating said battery voltage.

25. A programmable hearing aid as claimed in claim 23 wherein said power supply means comprises means for supplying said analog part with reference currents.

26. A programmable hearing aid as claimed in claim 1 wherein said power supply means comprises a battery, and wherein said programmable hearing aid further comprises an on-off switch for shutting said analog part and said digital part off with said analog part and said digital part remaining connected to said battery, and wherein said power supply means further comprises decoder means for controlling operation of said analog part and said digital part in an off state.

27. A programmable hearing aid as claimed in claim 26 further comprising means for monitoring a voltage of said battery and for generating a signal identifying a need to replace said battery when said voltage falls below a predetermined value.

28. A programmable hearing aid as claimed in claim 26 wherein said decoder means comprises means for switching said analog part and said digital part to one of a plurality of operating states from said off condition.

29. A programmable hearing aid as claimed in claim 28 further comprising means for supplying an input signal to said decoder means, and wherein said decoder means comprises means for activating predetermined components of said analog part and said digital part dependent on said input signal.

30. A programmable hearing aid as claimed in claim 29 wherein said means for supplying an input signal to said decoder means comprises a manually operable switch.

31. A programmable hearing aid as claimed in claim 29 wherein said means for supplying said input signals to said decoder means comprises a remote control.

32. A programmable hearing aid as claimed in claim 29 wherein said second audio signal source comprises a telephone coil, wherein said means for supplying an input signal to said decoder means comprises means for supplying a signal identifying a telephone coil mode of operation, wherein said digital part comprises a memory containing data for operating said analog part in said telephone coil mode, and wherein said digital part comprises means for setting at least said gains of said amplifier units and said selectable gain of said Class D amplifier means dependent on said telephone coil mode data.

33. A programmable hearing aid as claimed in claim 28 wherein said digital part comprises a memory containing respective data sets for operating said analog part in each of said operating states, and wherein said digital part comprises means connected to said memory for activating only components of said analog part to draw power from said power supply means which are to be used in a current operating mode, and for deactivating power supply to all other components of said analog part.

34. A programmable hearing aid as claimed in claim 1 further comprising means for connecting a further audio signal source to said analog part, and means for recognizing when said further audio signal source is connected to said analog part for placing said analog part and said digital part in a predetermined operating mode associated with said further audio signal source.

35. A programmable hearing aid as claimed in claim 1 wherein said second audio signal source comprises a telephone coil, and wherein said digital part comprises interface means for programming said digital part for operation in a telephone coil mode including automatic activation of said telephone coil by said digital part.

36. A programmable hearing aid as claimed in claim 1 wherein said analog part, said digital part and said power supply means comprise, in combination, a monolithically integrated circuit.

37. A programmable hearing aid comprising:

an analog part for processing incoming audio signals, including a microphone, a telephone coil, pre-amplifier means for pre-amplifying signals from said microphone and said telephone coil to produce a pre-amplified output, automatic gain control means for automatically amplifying said pre-amplified output with a variable gain dependent on a characteristic of said pre-amplified output to produce an AGC output, filter means for filtering said AGC output to produce a filtered output, Class D amplifier means, having an input supplied with said filtered output and having an output, for amplifying said filtered output with a selected gain, means connected to said Class D amplifier means for setting said selected gain, and an earphone connected to said output of said Class D amplifier means;

a digital part comprising means for generating and supplying a plurality of control signals for operating said analog part at a basic setting, including a first control signal for controlling respective amplification of signals from said microphone and said telephone coil in said pre-amplifier means and a second control signal supplied to said means for setting said selected gain for controlling the setting of the gain of said Class D amplifier means, memory means for storing a telephone coil mode setting, deviating from said basic setting, and interface means for selectively causing said means for generating said control signals to employ said telephone coil mode setting instead of said basic setting.

* * * * *